US009803517B2

(12) United States Patent
Lambert et al.

(10) Patent No.: US 9,803,517 B2
(45) Date of Patent: Oct. 31, 2017

(54) VALVE-ACTUATING LEVER FOR RECIPROCATING-PISTON INTERNAL COMBUSTION ENGINES

(71) Applicant: Schaeffler Technologies AG & Co. KG, Herzogenaurach (DE)

(72) Inventors: Martin Lambert, Homburg (DE); Ralph Teichgraber, Hochstadt (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 110 days.

(21) Appl. No.: 14/940,673

(22) Filed: Nov. 13, 2015

(65) Prior Publication Data

US 2016/0153320 A1 Jun. 2, 2016

(30) Foreign Application Priority Data

Dec. 2, 2014 (DE) ..... 10 2014 224 625

(51) Int. Cl.
*F01L 1/18* (2006.01)

(52) U.S. Cl.
CPC ..... *F01L 1/18* (2013.01); *F01L 1/185* (2013.01)

(58) Field of Classification Search
CPC ..... F01L 1/18; F01L 1/185
USPC ..... 123/90.39, 90.44
See application file for complete search history.

(56) References Cited

U.S. PATENT DOCUMENTS 5,325,825 A 7/1994 Schmidt et al.
9,556,755 B2 * 1/2017 Dupke ..... B21D 53/84 123/90.39

FOREIGN PATENT DOCUMENTS

DE 4234868 4/1994
DE 102013203956 A1 * 9/2014 ..... B21D 53/84

* cited by examiner

*Primary Examiner* — Ching Chang
(74) *Attorney, Agent, or Firm* — Volpe and Koenig, P.C.

(57) ABSTRACT

A valve-actuating lever for reciprocating-piston internal combustion engines is proposed, wherein this lever is supported on a cylinder head of the internal combustion engine or a part of this cylinder head, is in active connection with a cam of a camshaft, has an essentially inverted U-shaped cross section, is made from steel sheet metal by a punching, bending, and/or deep-drawing measure, and has, in addition to a support plate (5) for a shaft of a gas-exchange valve or for an intermediate piece, lateral guide cheeks (3, 4). A height of the lateral guide cheeks (3, 4) can be changed with regard to the support plate (5) by an embossing procedure.

4 Claims, 2 Drawing Sheets

VALVE-ACTUATING LEVER FOR RECIPROCATING-PISTON INTERNAL COMBUSTION ENGINES

INCORPORATION BY REFERENCE

The following documents are incorporated herein by reference as if fully set forth: German Patent Application No. 102014224625.3, filed Dec. 2, 2014.

BACKGROUND

The invention relates to a valve-actuating lever for reciprocating-piston internal combustion engines, which is supported on a cylinder head of the internal combustion engine or a part of this cylinder head, is in active connection with a cam of a camshaft, has an essentially inverted U-shaped cross section, is produced from steel sheet metal by a punching, bending, and/or deep-drawing measure, and has, in addition to a support plate for a shaft of a gas-exchange valve or for an intermediate piece, lateral guide cheeks.

U-shaped rocker arms and cam followers made with forging and shape-forming processes are generally known. In the cam follower from DE 42 34 868 A1 that is punched and pressed from sheet metal, the guide cheeks are part of the punched part and the cheeks are then bent. This process produces a certain height of the guide cheeks relative to a support plate arranged in-between, wherein this support plate is in active connection with the end of the valve shaft. If the distance of the valve shaft end relative to a plate supported on the valve shaft for a valve spring is equal to or shorter than the distance between the support plate and the ends of the guide cheeks, then there is the problem that the guide cheeks will contact the spring plate. This is not permissible.

SUMMARY

The objective of the invention is to improve a valve-actuating lever in the form of a cam follower or rocker arm, so that the described disadvantages are eliminated, without fundamental changes having to be made in the punching, bending, and/or deep-drawing process of the valve-actuating levers. The invention should be realized with simple, economical means.

According to the invention, the objective is achieved in that the height of the guide cheeks relative to the support plate can be changed by an embossing process. Through this measure, the height of the lateral guide cheeks on an already essentially finished cam follower or rocker arm can be easily adjusted. For this purpose, an embossing support and an embossing tool are used, wherein the tool has a narrower or equal-size design compared with the distance between the guide cheeks, so that the support plate with the web of the U-shaped end area of the cam follower or rocker arm arranged above is lowered as far as is desired for the provided use. The embossing support here has the shape of the final form of the end area of the valve-actuating lever, in particular, with regard to the distance between the ends of the guide cheeks and the support plate, as well as the distance between the guide cheeks. Viewed in the longitudinal direction of the cam follower, the embossing tool has a circular segment-shaped design corresponding to the shape of the support plate, which is selected, as is known, so that, as much as possible, there are no transverse forces acting on the valve shaft.

BRIEF DESCRIPTION OF THE DRAWINGS

The invention is described in the drawings, in which.

DETAILED DESCRIPTION OF THE PREFERRED EMBODIMENTS

Figure 1:
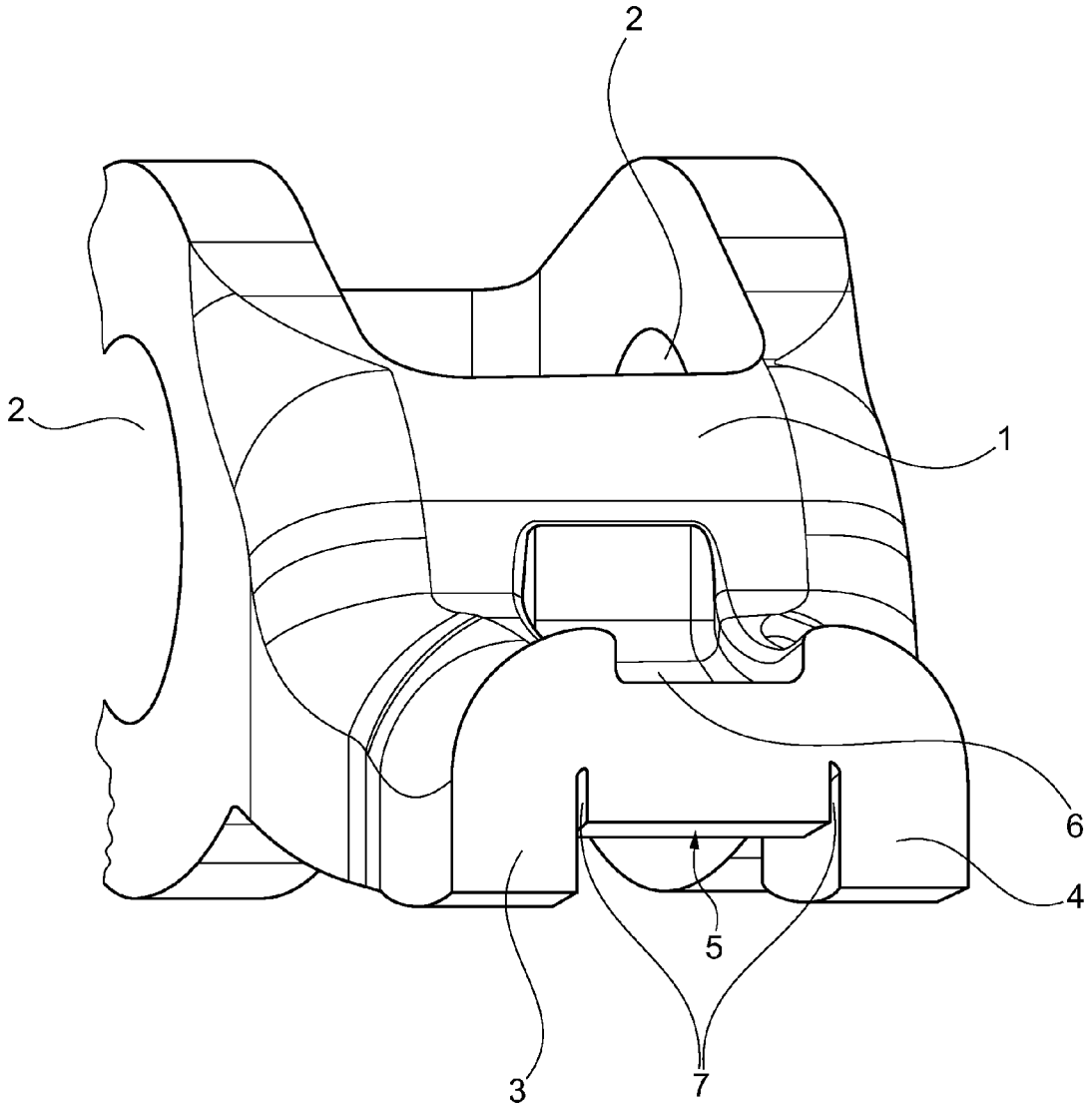
FIG. 1 shows a perspective view of the end of a cam follower facing the gas-exchange valve.
Figure 2:
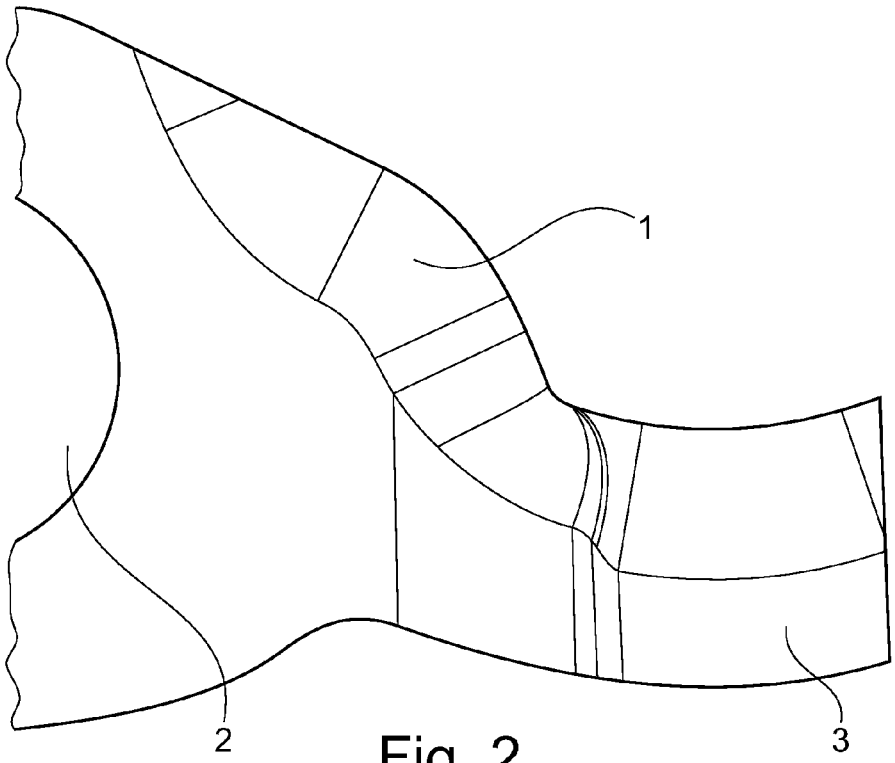
FIG. 2 shows a side view of the cam follower end according to FIG. 1.
Figure 3:
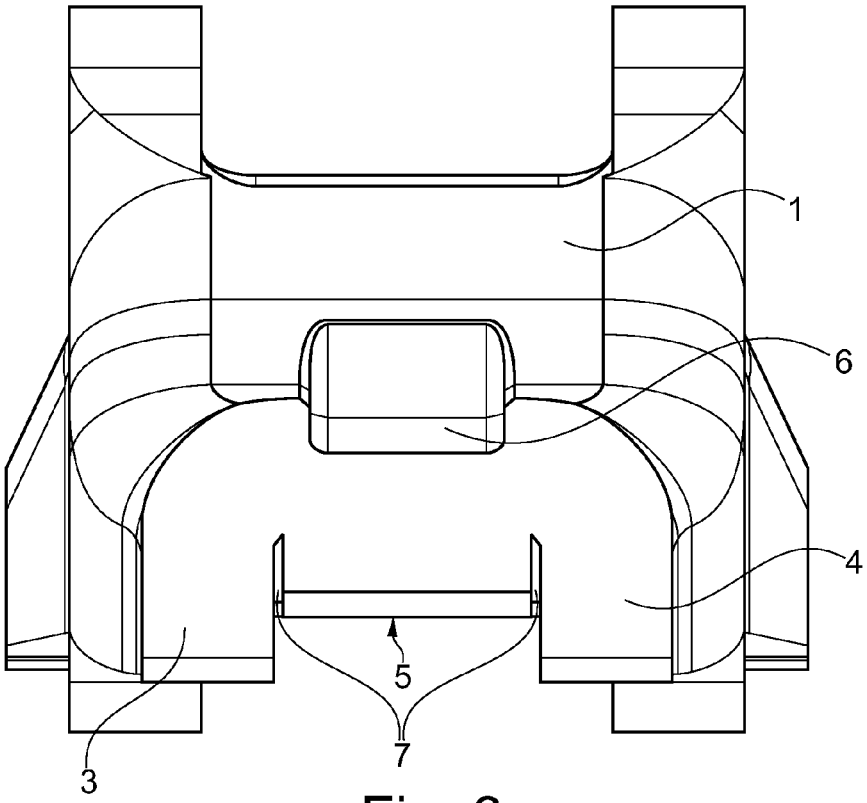
FIG. 3 shows a front view of the corresponding cam follower end.

In FIGS. 1 to 3, as far as shown in detail, a cam follower is indicated with 1 that has an inverted U-shaped design and openings 2 for a bolt for supporting a roller, wherein the roller, not shown, contacts a cam of a camshaft. The cam follower 1 is supported with one end, e.g., on a valve lash compensating element guided in the cylinder head, not shown. On the other, opposite end, the cam follower has lateral guide cheeks 3 and 4 that are connected to each other by a web area, wherein the web area forms a support plate 5 that connects, not shown, to the shaft of a gas-exchange valve or a corresponding intermediate piece. Above the support plate 5, an embossing mark 6 is visible that originates from an embossing tool. By applying an embossing force on the embossing mark 6 and supporting the lateral guide cheeks 3 and 4, the height of the lateral guide cheeks is varied relative to the support plate 5 until also the support plate 5 contacts an embossing support. This can be seen in that the support plate 5 has separating beads 7 opposite the lateral guide cheeks 3 and 4, wherein these beads are produced by embossing and moving the support plate 5 relative to the lateral guide cheeks 3 and 4. The separating beads 7 can contact the guide cheeks 3 and 4 to realize their function. This embossing measure allows the arbitrary setting of the height of the lateral guide cheeks 3 and 4 relative to the support plate 5 or the distance between the support plate 5 and the ends of the lateral guide cheeks 3 and 4.

LIST OF REFERENCE SYMBOLS

1) Cam follower
2) Openings
3), 4) Side guide cheeks
5) Support plate
6) Embossing mark
7) Separating bead

The invention claimed is:

1. A valve-actuating lever for reciprocating-piston internal combustion engines, wherein the valve-actuating lever is supported on a cylinder head of the internal combustion engine or a part of the cylinder head and contacts a cam of a camshaft, the valve-actuating lever comprising an essentially inverted U-shaped cross section formed from steel sheet metal that is at least one of punched, bent, or deep-drawn, and includes a support plate defining a support surface for a shaft of a gas-exchange valve or an intermediate piece, and lateral guide cheeks, and a height of the lateral guide cheeks with respect to the support plate is changed by embossing an opposite side of the support plate such that a top surface of the support plate opposite the support surface is indented relative to the lateral guide cheeks.

2. The valve-actuating lever according to claim 1, wherein the embossing is narrower than or equal to a distance between the lateral guide cheeks.

3. The valve-actuating lever according to claim 1, wherein the embossing is, viewed in a longitudinal direction relative to the valve-actuating lever, a circular segment-shaped recess that corresponds to a shape of the support plate.

4. A method for producing a valve-actuating lever according to claim 1, comprising:

providing an embossing support with two side steps that essentially correspond to a desired distance of ends of the lateral guide cheeks to the support plate that contacts an end of the valve-actuating lever from a direction of the gas-exchange valve; and applying a load on an embossing tool against an outer web of the support plate until a final distance between the support plate and the ends of the lateral guide cheeks is achieved.

* * * * *